US005711895A

United States Patent [19]

Takigawa et al.

[11] Patent Number: 5,711,895

[45] Date of Patent: Jan. 27, 1998

[54] FLUID COMPOSITION FOR USE IN A REFRIGERATING MACHINE IN WHICH THE REFRIGERATING MACHINE OIL IS AT LEAST ONE HYDROCARBON COMPOUND OF A FORMULA CONSISTING OF TWO PHENYL GROUPS JOINED THROUGH AN ALKYLENE OR ALKENYLENE GROUP

[75] Inventors: Katsuya Takigawa; Umekichi Sasaki; Satoshi Suda, all of Yokohama, Japan

[73] Assignee: Nippon Oil Co., Ltd., Tokyo, Japan

[21] Appl. No.: 566,620

[22] Filed: Dec. 4, 1995

[30] Foreign Application Priority Data

| | | | |
|---|---|---|---|
| Dec. 12, 1994 | [JP] | Japan | 6-331367 |
| Jan. 11, 1995 | [JP] | Japan | 7-018350 |
| Jan. 11, 1995 | [JP] | Japan | 7-018351 |

[51] Int. Cl.[6] ..... C09K 5/04; C10M 105/06

[52] U.S. Cl. ..... 252/68; 252/67

[58] Field of Search ..... 252/68, 67

[56] References Cited

U.S. PATENT DOCUMENTS

| | | | |
|---|---|---|---|
| 4,046,533 | 9/1977 | Olund | 62/468 |
| 4,347,169 | 8/1982 | Sato et al. | 252/567 |
| 4,946,611 | 8/1990 | Kaneko | 252/49.6 |
| 5,295,357 | 3/1994 | Kaneko | 62/84 |
| 5,368,765 | 11/1994 | Kaneko | 252/68 |
| 5,520,833 | 5/1996 | Kaneko | 252/68 |

FOREIGN PATENT DOCUMENTS

| | | |
|---|---|---|
| 0638629 | 2/1995 | European Pat. Off. . |
| 2414545 | 8/1979 | France . |
| 2801087 | 7/1978 | Germany . |
| 3215312 | 11/1982 | Germany . |
| 4028747 | 3/1992 | Germany . |
| 803564 | 10/1958 | United Kingdom . |

*Primary Examiner*—Christine Skane
*Attorney, Agent, or Firm*—Bucknam And Archer

[57] ABSTRACT

A refrigerating machine oil for use with a hydrofluorocarbon refrigerant in a refrigerator, which comprises at least one member selected from the group consisting of hydrocarbon compounds represented by the following general formulas (1), (2) and (3)

(1)

(2)

(3)

(wherein R represents an alkylene group or alkenylene group having 1 to 8 carbon atoms; $R^1$, $R^2$, $R^3$ and $R^4$ may be the same or different and are each a hydrogen atom or an alkyl group having 1 to 4 carbon atoms, the total number of carbon atoms of R, $R^1$, $R^2$, $R^3$ and $R^4$ being within a range of 1 to 8; and $R^6$, $R^7$, $R^8$ and $R^9$ may be the same or different and are each a hydrogen atom or a hydrocarbon group having 1 to 10 carbon atoms, the total number of carbon atoms of $R^6$, $R^7$, $R^8$ and $R^9$ being within a range of 1 to 10). In other embodiments, a fluid composition for use in refrigerating machine which comprises a hydrofluorocarbon refrigerant and at least one hydrocarbon compound, a refrigerating machine which uses therein the fluid composition as a circulating fluid, and a method of lubricating a cooling system of a refrigerator using therein a hydrofluorocarbon refrigerant by using said refrigerator oil in the cooling system.

8 Claims, No Drawings

FLUID COMPOSITION FOR USE IN A REFRIGERATING MACHINE IN WHICH THE REFRIGERATING MACHINE OIL IS AT LEAST ONE HYDROCARBON COMPOUND OF A FORMULA CONSISTING OF TWO PHENYL GROUPS JOINED THROUGH AN ALKYLENE OR ALKENYLENE GROUP

BACKGROUND OF THE INVENTION

1. Field of the Invention

The present invention relates to a refrigerating machine oil (a refrigerating machine lubricating oil), a fluid composition for use in a refrigerating machine, a refrigerating machine using therein a hydrofluorocarbon refrigerant with said refrigerator oil and a method of lubricating a cooling system. More particularly, this invention relates to a refrigerating machine oil which comprises at least one hydrocarbon compound having a specific structure and is suitable for use with a hydrofluorocarbon (HFC) refrigerant, to a fluid composition for use in a refrigerating machine, which comprises the hydrofluorocarbon refrigerant and the refrigerating machine oil, to a refrigerating machine using therein the above-mentioned fluid composition and to a method of lubricating a cooling system of a refrigerating machine using therein the hydrofluorocarbon (HFC) as a refrigerant, characterized by using the refrigerator oil as a lubricating oil in said cooling system.

2. Prior Art

Due to the recent problems raised as to the destruction of ozone layer, the use of chlorofluorocarbon (CFC) and hydrochlorofluorocarbon (HCFC), which have been conventionally used as a refrigerant for a refrigerating machine, is now restricted under the regulation concerned. Therefore, as a replacement of these materials, hydrofluorocarbon (HFC) has been increasingly employed as a refrigerant.

Meanwhile, the compatibility of a refrigerating machine oil with a refrigerant is one of the important requirements for the refrigerating machine oil. Hydrocarbon oils such as mineral oils and alkylbenzenes have been used as a refrigerating machine oil for use with CFC and HCFC. However, HFC is hardly compatible with these mineral oils and alkylbenzenes. Under the circumstances, oxygen-containing oils such as polyalkylene glycols (PAG) and esters which are compatible with HFC have been studied or used as a refrigerating machine oil for use with a HFC refrigerant. For example, the use of PAG is disclosed in U.S. Pat. No. 4,755,316, Japanese Pat. Appln. Laid-Open Gazettes Nos. Hei 1-198694, Hei 1-256594, Hei 1-259093, Hei 1-259094, Hei 1-259095, Hei 1-274191, Hei 2-43290, Hei 2-55791 and Hei 2-84491. The use of esters is disclosed in PCT Publication No. Hei 3-505602, Japanese Pat. Appln. Laid-Open Gazettes Nos. Hei 3-88892, Hei 2-128991, Hei 3-128992, Hei 3-200895, Hei 3-227397, Hei 4-20597, Hei 4-72390, Hei 4-218592 and Hei 4-249593.

However, PAG is rather high in hygroscopicity and poor in electric insulating property. On the other hand, ester-based oils are readily hydrolyzed to generate an acid thus possibly giving rise to various problems. Moreover, these oxygen-containing oils raise a serious problem because they are poor in lubricity as compared with a hydrocarbon oil/CFC or a hydrocarbon oil HCFC.

On the other hand, Japanese Pat. Appln. Laid-Open Gazette No. Hei 15-157879 describes a refrigerating system suited for using therein a HFC-134a refrigerant wherein there is used a refrigerating machine oil which is incompatible with a refrigerant. As examples of such an oil, there are shown hydrocarbon oils such as mineral oils, poly α-olefin and alkylbenzenes, which are excellent in electric insulating property and chemical stability and are low in hygroscopicity. However, it has been found that if a hydrocarbon oil such as alkylbenzenes is used as a refrigerating machine oil for use with HFC-134a, some specific measures are required to be taken on the side of cooling system due to incompatibility of the hydrocarbon oil with HFC-134a.

As explained above, the oxygen-containing oil generally has characteristics which conflict with the characteristics of the hydrocarbon oil and therefore the object of developing a refrigerating machine oil which is usable with a HFC refrigerant and is capable of exhibiting not only the features of the oxygen-containing oil, but also the features of the hydrocarbon oil has not been achieved.

SUMMARY OF THE INVENTION

An object of this invention is to provide a refrigerating machine oil which is compatible with a HFC refrigerant and meets various requirements such as stability against hydrolysis, electric insulation and lubricity.

Another object of this invention is to provide a fluid composition for refrigerating machine which comprises the above-mentioned refrigerating machine oil and the HFC refrigerant.

Still another object of this invention is to provide a refrigerating machine in which the above-mentioned fluid composition is used as a circulating fluid.

A further object of this invention is to provide a method of lubricating a cooling system using therein HFC as a refrigerant by using the above-mentioned refrigerating machine oil as a lubricating oil in the system.

After their extensive studies for developing a refrigerating machine oil having excellent compatibility and other various excellent properties, the present inventors have succeeded in finding out a hydrocarbon compound of a specific structure which is highly compatible with a HFC refrigerant and meets various requirements for a refrigerating machine oil. The present invention has thus been accomplished.

Namely, according to this invention, there is provided a refrigerating machine oil for use with a hydrofluorocarbon refrigerant, which comprises at least one member selected from the group consisting of hydrocarbon compound represented by the following general formulas (1), (2) and (3)

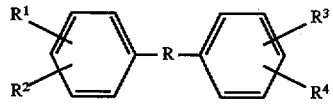

(1)

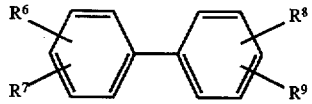

(2)

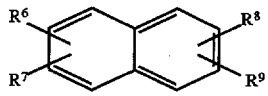

(3)

wherein R represents an alkylene group or alkenylene group having 1 to 8 carbon atoms; and $R^1$, $R^2$, $R^3$ and $R^4$ may be identical with or different from each other and are each a hydrogen atom or an alkyl group having 1 to 4 carbon atoms with the proviso that the total number of carbon atoms of R, $R^1$, $R^2$, $R^3$ and $R^4$ is within a range of 1 to 8; and $R^6$, $R^7$, $R^8$ and $R^9$ may be identical with or different from each other and are each a hydrogen atom or an hydrocarbon group having 1 to 10 carbon atoms with the proviso that the total number of carbon atoms of $R^6$, $R^7$, $R^8$ and $R^9$ is within a range of 1 to 10.

According to the present invention, there is further provided a fluid composition for use in a refrigerating machine, which comprises [I] a hydrofluorocarbon refrigerant; and [II] at least one member selected from the group consisting of hydrocarbon compounds represented by the following general formulas (1), (2) and (3)

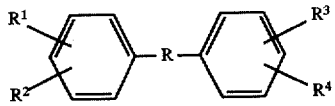
(1)

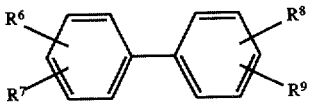
(2)

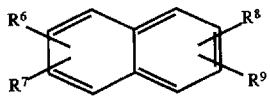
(3)

wherein R represents an alkylene group or alkenylene group having 1 to 8 carbon atoms; and $R^1$, $R^2$, $R^3$ and $R^4$ may be identical with or different from each other and are each a hydrogen atom or an alkyl group having 1 to 4 carbon atoms with the proviso that the total number of carbon atoms of R, $R^1$, $R^2$, $R^3$ and $R^4$ is within a range of 6 to 8; and $R^6$, $R^7$, $R^8$ and $R^9$ may be identical with or different from each other and are each a hydrogen atom or a hydrocarbon group having 1 to 10 carbon atoms with the proviso that the total number of carbon atoms of $R^6$, $R^7$, $R^8$ and $R^9$ is within a range of 1 to 10.

According to the present invention, there is further provided a refrigerating machine which uses therein a fluid composition as a circulating fluid, said fluid composition comprising [I] a hydrofluorocarbon refrigerant and [II] a refrigerating machine oil comprising at least one member selected from the group consisting of hydrocarbon compounds represented by the following general formulas (1), (2) and (3)

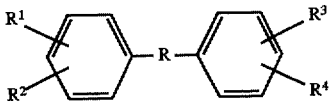
(1)

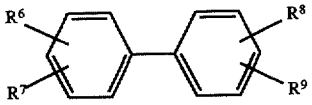
(2)

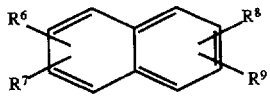
(3)

wherein R represents an alkylene group or alkenylene group having 1 to 8 carbon atoms; and $R^1$, $R^2$, $R^3$ and $R^4$ may be identical with or different from each other and are each a hydrogen atom or an alkyl group having 1 to 4 carbon atoms with the proviso that the total number of carbon atoms of R, $R^1$, $R^2$, $R^3$ and $R^4$ is within a range of 1 to 8; and $R^6$, $R^7$, $R^8$ and $R^9$ may be identical with or different from each other and are each hydrogen atom or a hydrocarbon group having 1 to 10 carbon atoms with the proviso that the total number of carbon atoms of $R^6$, $R^7$, $R^8$ and $R^9$ is within a range of 1 to 10.

According to this invention, there is further provided a method of lubricating a cooling system of a refrigerating machine using therein hydrofluorocarbon as a refrigerant, wherein a lubricating oil is used, comprising at least one hydrocarbon compound selected from the group consisting of hydrocarbon compounds represented by the following general formulas (1), (2) and (3)

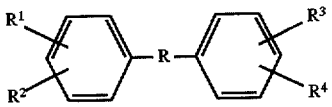
(1)

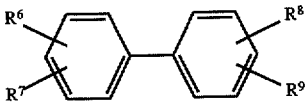
(2)

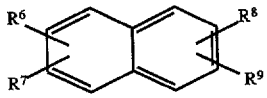
(3)

wherein R represents an alkylene group or alkenylene group having 1 to 8 carbon atoms; and $R^1$, $R^2$, $R^3$ and $R^4$ may be identical with or different from each other and are each a hydrogen atom or an alkyl group having 1 to 4 carbon atoms with the proviso that the total number of carbon atoms of R, $R^1$, $R^2$, $R^3$ and $R^4$ is within a range of 1 to 8; and $R^6$, $R^7$, $R^8$ and $R^9$ may be identical with or different from each other and are each a hydrogen atom or a hydrocarbon group having 1 to 10 carbon atoms with the proviso that the total number of carbon atoms of $R^6$, R, $R^7$, $R^8$ and $R^9$ is within a range of 1 to 10.

This invention will be further explained in detail.

The refrigerating machine oil of this invention comprises at least one hydrocarbon compound selected from the group consisting of hydrocarbon compounds represented by the general formulas (1), (2) and (3)

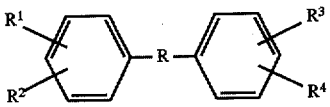
(1)

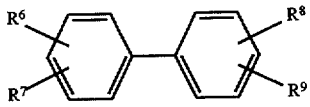
(2)

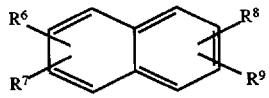
(3)

wherein R represents an alkylene group or alkenylene group having 1 to 8 carbon atoms; $R^1$, $R^2$, $R^3$ and $R^4$ may be the same or different and are each a hydrogen atom or an alkyl group having 1 to 4 carbon atoms, the total number of carbon atoms of R, $R^2$, $R^2$, $R^3$ and $R^4$ being within a range of 1 to 8; and $R^6$, $R^7$, $R^8$ and $R^9$ may be the same or different and are each a hydrogen atom or a hydrocarbon group having 1 to 10 carbon atoms, the total number of carbon atoms of $R^6$, $R^7$, $R^8$ and $R^9$ being within a range of 1 to 10. If the R in the general formula (1) is an alkylene group or alkenylene group having at least 9 carbon atoms, if at least one of $R^1$, $R^2$, $R^3$ and $R^4$ in the general formula (1) is an alkyl group having at least 5 carbon atoms or if the total number of carbon atoms of R, $R^1$, $R^2$, $R^3$ and $R^4$ is at least 9, then the compatibility of the hydrocarbon compound with the HFC refrigerant would be undesirably deteriorated.

The R in the general formula (1) represents an alkylene group or alkenylene group having 1 to 8 carbon atoms as mentioned above.

Examples of the R are methylene; alkylenes having two carbon atoms, such as methylmethylene (ethylidene) and ethylene; alkylenes having three carbon atoms, such as ethylmethylene (propylidene), dimethylmethylene (isopropylidene), methylethylene (propylene) and trimethylene; alkylenes having four carbon atoms, such as n-propylmethylene (butylidene), isopropylmethylene (isobutylidene), ethylmethyl methylene, ethylethylene, 1,1-dimethylethylene, 1,2-dimethylethylene, 1-methyltrimethylene, 2-methyl trimethylene and tetramethylene; alkylenes having five carbon atoms, such as n-butylmethylene (pentylidene), sec-butylmethylene, isobutylmethylene (isopentylidene), tert-butylmethylene, n-propylmethylmethylene, isopropylmethylmethylene, diethylmethylene, n-propylethylene, isopropyl ethylene, 1-ethyl-1-methylethylene, 1-ethyl-2-methyl ethylene, trimethylethylene, 1-ethyltrimethylene, 2-ethyltrimethylene, 1,1-dimethyltrimethylene, 1,2-dimethyltrimethylene, 1,3-dimethyltrimethylene, 2,2-dimethyltrimethylene, 1-methyltetramethylene, 2-methyltetramethylene and pentamethylene; alkylenes having six carbon atoms (including all isomers of alkylenes having six carbon atoms), such as n-pentyl methylene (hexylidene), (1-methylbutyl) methylene, isopentylmethylene (isopentylidene), (1,2-dimethylpropyl) methylene, n-butylmethylmethylene, isobutylmethylmethylene, ethyl-n-propylmethylene, ethylisopropylmethylene, butylethylene, isobutyl methylene, 1-(n-propyl)-1-methylethylene, 1-(n-propyl)-2-methylethylene, 1-isopropyl-1-methyl ethylene, 1-isopropyl-2-methylethylene, 1,2-diethyl ethylene, 1-ethyl-2,2-dimethylethylene, tetramethyl ethylene, 1-n-propyltrimethylene, 2-n-propyl trimethylene, 1-isopropyltrimethylene, 2-isopropyl trimethylene, 1-ethyl-3-methyltrimethylene, 1-ethyl-2-methyltrimethylene, 1,1,2-trimethyltrimethylene, 1,1,3-trimethyltrimethylene, 1-ethyltetramethylene, 1,1-dimethyltetramethylene, 1,3-dimethyl tetramethylene, 1,4-dimethyltetramethylene, 2,2-dimethyltetramethylene, 1-methylpentamethylene, 2-methylpentamethylene and hexamethylene; alkylenes having seven carbon atoms (including all isomers of alkylenes having seven carbon atoms), such as n-hexyl methylene (heptylidene) and n-pentylethylene (heptylene); alkylenes having eight carbon atoms (including all isomers of alkylenes having eight carbon atoms), such as n-heptylmethylene (octylidene) and n-hexylethylene (octylene); alkenylenes having two carbon atoms such as vinylidene and ethenylene (vinylene); alkenylenes having three carbon atoms such as propenylene, methyleneethylene, methylethenylene, 1-propenylidene and 2-propenylidene; alkenylenes having four carbon atoms (including all isomers of alkenylenes having four carbon atoms) such as 3-methyl propenylene; alkenylenes having five carbon atoms (including all isomers of alkenylenes having five carbon atoms) such as 1-methyl-3-methylene trimethylene, 3-ethylpropenylene, 1,3-dimethyl propenylene, 2,3-dimethylpropenylene and 3,3-dimethyl propenylene; alkenylenes having six carbon atoms (including all isomers of alkenylenes having six carbon atoms) such as 1,1-dimethyl-3-methylenetrimethylene, 1-ethyl-3-methylenetrimethylene, 3-ethyl-1-methyl propenylene, 3-ethyl-2-methylpropenylene, 1,3,3-trimethylpropenylene and 2,3,3-trimethylpropenylene; alkenylene having seven carbon atoms (including all isomers of alkenylene having seven carbon atoms) such as heptenylene; and alkenylene having eight carbon atoms (including all isomers of alkenylene having eight carbon atoms) such as octenylene.

Among them, more preferable examples of the R are alkylene and alkenylene groups having 1 to 6 carbon atoms, and the most preferable examples of them are: alkylenes having 1 to 3 carbon atoms such as methylene, methylmethylene (ethylidene), ethylene, ethylmethylene (propylidene), dimethylmethylene (isopropylidene), methylethylene (propylene) and trimethylene; alkenylenes having 2 to 3 carbon atoms such as vinylidene, ethenylene (vinylene), propenylene, methyleneethylene, methylethenylene, 1-propenylidene and 2-propenylidene; alkylenes having 4 to 6 carbon atoms such as 1-methyltrimethylene, 1-ethyl trimethylene, 1,1-dimethyltrimethylene, 1,2-dimethyl trimethylene, 1,3-dimethyltrimethylene, 1-ethyl-3-methyltrimethylene, 1-ethyl-2-methyltrimethylene, 1,1,2-trimethyltrimethylene, 1,1,3-trimethyl trimethylene; and alkenylenes having 4 to 6 carbon atoms such as 3-methylpropenylene, 1-methyl-3-methylenetrimethylene, 3-ethylpropenylene, 1,3-dimethylpropenylene, 2,3-dimethylpropenylene, 3,3-dimethylpropenylene, 1,1-dimethyl-3-methylene trimethylene, 1-ethyl-3-methylenetrimethylene, 3-ethyl-1-methylpropenylene, 3-ethyl-2-methyl 20 propenylene, 1,3, 3-trimethylpropenylene and 2,3,3-trimethylpropenylene.

The $R^1$, $R^2$, $R^3$ and $R^4$ in the hydrocarbon compounds represented by the general formula (1) may be the same or different and are each a hydrogen atom or an alkyl group having 1 to 4 carbon atoms. The alkyl groups having 1 to 4 carbon atoms include methyl, ethyl, n-propyl, isopropyl, n-butyl, sec-butyl, isobutyl and tert-butyl.

The total number of carbon atoms of R, $R^1$, $R^2$, $R^3$ and $R^4$ in the hydrocarbon compounds represented by the general formula (1) is within a range of 1 to 8, preferably 1 to 6.

The hydrocarbon compounds represented by the general formula (1) include hydrocarbon compounds having a methylene group, such as diphenylmethane, phenyltolylmethane, phenylxylylmethane, ditolylmethane, tolylxylylmethane, dixylylmethane, (ethylphenyl) phenylmethane, (ethylphenyl) tolylmethane, (ethylmethylphenyl) phenylmethane, (ethylphenyl) xylylmethane, (ethylmethylphenyl) tolylmethane, (ethylmethylphenyl) xylylmethane, (diethylphenyl) phenylmethane, bis(ethylphenyl) methane, (diethylphenyl) tolylmethane, (ethylmethylphenyl) (ethylphenyl) methane, phenyl(n-propylphenyl) methane, phenyl(isopropylphenyl) methane, (n-propylphenyl) tolylmethane, (isopropylphenyl) tolylmethane, (methyl-n-propylphenyl) phenylmethane, (methyl isopropylphenyl) phenylmethane, (methyl-n-propylphenyl) tolylmethane, (methylisopropylphenyl) tolylmethane, (n-propylphenyl) xylylmethane, (isopropylphenyl) xylylmethane, (methyl-n-propylphenyl) phenylmethane, (ethylisopropylphenyl) phenylmethane, (ethylphenyl) (n-propylphenyl) methane, (ethylphenyl) (isopropylphenyl) methane, (n-butylphenyl) phenylmethane, (isobutylphenyl) phenylmethane, (sec-butylphenyl) phenylmethane, (tert-butylphenyl) phenylmethane, (n-butylmethylphenyl) phenylmethane, (isobutylmethylphenyl) phenylmethane, (sec-butylmethylphenyl) phenylmethane, (tert-butylmethylphenyl) phenylmethane, (n-butylphenyl) tolylmethane, (isobutylphenyl) tolylmethane, (sec-butylphenyl) tolylmethane and (tert-butylphenyl) tolylmethane;

hydrocarbon compounds having a methylmethylene group (ethylidene group), such as 1,1-diphenylethane, 1-phenyl-1-tolylethane, 1-phenyl-1-xylylethane, 1,1-ditolylethane, 1-tolyl-1-xylylethane, 1,1-dixylylethane, 1,1-(ethylphenyl)-1-phenylethane, 1-(ethylphenyl)-1-tolylethane, 1-(ethylmethylphenyl)-1-phenylethane, 1,1-(ethylphenyl)-1-xylylethane, 1-(ethylmethylphenyl)-1-tolylethane, 1-(diethylphenyl)-1,1-bis(ethylphenyl) ethane, 1-phenyl-1-(n-propylphenyl) ethane, 1-phenyl-1-(isopropylphenyl) ethane, 1-(n-propylphenyl)-1-tolylethane, 1-(isopropylphenyl)-1-tolylethane, 1-(methyl-n-propylphenyl)-1-phenylethane, 1-(methyl isopropylphenyl)-1-phenylethane, 1-(n-butylphenyl)-1-phenylethane, 1-(isobutylphenyl)-1-phenylethane, 1-(sec-butylphenyl)-1-phenylethane and 1-(tert-butylphenyl)-1-phenylethane;

hydrocarbon compounds having an ethylene group, such as 1,2-diphenylethane, 1-phenyl-2-tolylethane, 1-phenyl-2-xylylethane, 1,2-ditolylethane, 1-tolyl-2-xylylethane, 1,2-dixylylethane, 1-(ethylphenyl)-2-phenylethane, 1-(ethylphenyl)-2-tolylethane, 1-(ethylmethylphenyl)-2-phenylethane, 1-(ethylphenyl)-2-xylylethane, 1-(ethylmethylphenyl)-2-tolylethane, 1-(diethylphenyl)-2-phenylethane, 1,2-bis(ethylphenyl) ethane, 1-phenyl-2-(n-propylphenyl) ethane, 1-phenyl-2-(isopropylphenyl) ethane, 1-(n-propylphenyl)-2-tolylethane, 1-(isopropylphenyl)-2-tolylethane, 1-(methyl-n-propylphenyl)-2-phenylethane, 1-(methyl isopropylphenyl)-2-phenylethane, 1-(n-butylphenyl)-2-phenylethane, 1-(isobutylphenyl)-2-phenylethane, 1-(sec-butylphenyl)-2-phenylethane and 1-(tert-butylphenyl)-2-phenylethane;

hydrocarbon compounds having an ethylmethylene group (propylidene group), such as 1,1-diphenylpropane, 1-phenyl-1-tolylpropane, 1-phenyl-1-xylylpropane, 1,1-ditolylpropane, 1-tolyl-1-xylylpropane, 1-(ethylphenyl)-1-phenylpropane, 1-(ethylphenyl)-1-tolylpropane, 1-(ethylmethylphenyl)-1-phenylpropane, 1-phenyl-1-(n-propylphenyl) propane and 1-phenyl-1-(isopropylphenyl) propane;

hydrocarbon compounds having a methylethylene group (propylene group), such as 1,2-diphenylpropane, 1-phenyl-2-tolylpropane, 1-phenyl-2-xylylpropane, 1,2-ditolylpropane, 1-tolyl-2-xylylpropane, 1-(ethylphenyl)-2-phenylpropane. 1-(ethylphenyl)-2-tolylpropane, 1-(ethylmethylphenyl)-2-phenylpropane, 1-phenyl-2-(n-propylphenyl) propane, 1-phenyl-2-(isopropylphenyl) propane, 2-phenyl-1-tolyl propane, 2-phenyl-1-xylylpropane, 2-tolyl-1-xylylpropane, 2-(ethylphenyl)-1-phenylpropane, 2-(ethylphenyl)-1-tolylpropane. 2-(ethylmethylphenyl)-1-phenylpropane, 2-phenyl-1-(n-propylphenyl) propane and 2-phenyl-1-(isopropylphenyl) propane;

hydrocarbon compounds having a trimethylene group, such as 1,3-diphenylpropane, 1-phenyl-3-tolylpropane, 1-phenyl-3-xylylpropane, 1,3-ditolylpropane, 1-tolyl-3-xylylpropane, 1-(ethylphenyl)-3-phenylpropane. 1-(ethylphenyl)-3-tolylpropane, 1-(ethylmethylphenyl)-3-phenylpropane, 1-phenyl-3-(n-propylphenyl) propane and 1-phenyl-3-(isopropylphenyl) propane;

hydrocarbon compounds having a dimethylmethylene group (isopropylidene), such as 2,2-diphenylpropane, 2-phenyl-2-tolylpropane, 2-phenyl- 2-xylylpropane, 2,2-ditolylpropane, 2-tolyl-2-xylylpropane, 2-(ethylphenyl)-2-phenylpropane, 2-(ethylphenyl)-2-tolylpropane, 2-(ethylmethylphenyl)-2-phenylpropane, 2-phenyl-2-(n-propylphenyl) propane and 2-phenyl-2-(isopropylphenyl) propane;

hydrocarbon compounds having a 1-methyl trimethylene group, such as 1,3-diphenylbutane, 1-phenyl-3-tolylbutane, 1-phenyl-3-xylylbutane, 1-(ethylphenyl)-3-phenylbutane, 1,3-ditolylbutane, 3-phenyl-1-tolylbutane, 3-phenyl-1-xylylbutane and 3-(ethylphenyl)-1-phenylbutane;

hydrocarbon compounds having a tetramethylene group, such as 1,4-diphenylbutane, 1-phenyl-4-tolylbutane, 1-phenyl-4-xylylbutane, 1-(ethylphenyl)-4-phenylbutane and 1,4-ditolylbutane;

hydrocarbon compounds having a 1,2-dimethyl ethylene group, such as 2,3-diphenylbutane, 2-phenyl-3-tolylbutane, 2-phenyl-3-xylylbutane, (ethylphenyl)-3-phenylbutane and 2,3-ditolylbutane;

hydrocarbon compounds having a 1-ethyl trimethylene group, such as 1,3-diphenylpentane, 1-phenyl-3-tolylpentane and 3-phenyl-1-tolylpentane; hydrocarbon compounds having a 1-methyltetramethylene group, such as 1,4-diphenylpentane, 1-phenyl-4-tolylpentane and 4-phenyl-1-tolylpentane; hydrocarbon compounds having a pentamethylene group, such as 1,5-diphenylpentane and 1-phenyl-5-tolylpentane;

hydrocarbon compounds having a 1-ethyl-2-methylethylene group, such as 2,3-diphenylpentane, 2-phenyl-3-tolylpentane and 3-phenyl-2-tolylpentane;

hydrocarbon compounds having a 1,3-dimethyl trimethylene group, such as 2,4-diphenylpentane and 2-phenyl-4-tolylpentane;

hydrocarbon compounds having a 1,2-dimethyl trimethylene group, such as 2-methyl-1,3-diphenylbutane, 2-methyl-1-phenyl-3-tolylbutane and 2-methyl-3-phenyl-1-tolylbutane;

hydrocarbon compounds having a 1,1-dimethyl trimethylene group, such as 3-methyl-1,3-diphenylbutane, 3-methyl-1-phenyl-3-tolylbutane and 3-methyl-3-phenyl-1-tolylbutane;

hydrocarbon compounds having a 2-methyl tetramethylene group, such as 2-methyl-1,4-diphenylbutane, 2-methyl-1-phenyl-4-tolylbutane and 2-methyl-4-phenyl-1-tolylbutane;

hydrocarbon compounds having a 1,1,2-trimethylmethylene group, such as 2-methyl-2,3-diphenylbutane, 2-methyl-2-phenyl-3-tolylbutane and 2-methyl-3-phenyl-2-tolylbutane;

hydrocarbon compounds having an alkylene group having six carbon atoms, such as 1,1-diphenylhexane 1,2-diphenylhexane 1,3-diphenylhexane 1,4-diphenylhexane 1,5-diphenylhexane 1,6-diphenylhexane 2,2-diphenylhexane 2,3-diphenylhexane 2,4-diphenylhexane 2,5-diphenylhexane 3,3-diphenylhexane 3,4-diphenylhexane 2-methyl-1,1-diphenylpentane, 4-methyl-1,1-diphenylpentane, 2-methyl-1,2-diphenylpentane, 4-methyl-1,2-diphenylpentane, 2-methyl-1,3-diphenylpentane, 4-methyl-1,3-diphenylpentane, 2-methyl-1,4-diphenylpentane, 2-methyl-1,5-diphenylpentane, 4-methyl-2,2-diphenylpentane, 2-methyl-2,3-diphenylpentane, 2-methyl-2,4-diphenylpentane, 2-methyl-3,4-diphenylpentane, 2-methyl-2,5-diphenylpentane, 2-methyl-3,3-diphenylpentane, 2,3-dimethyl-1,1-diphenylbutane, 2,3-dimethyl-1,2-diphenylbutane, 2,3-dimethyl-1,4-diphenylbutane, 2,3-dimethyl-2,3-diphenylbutane, 2-benzyl-1-phenylpentane and 2-benzyl-3-methyl-1-phenylbutane;

hydrocarbon compounds having a vinylidene group, such as 1,1-diphenylethene, 1-phenyl-1-tolylethene, 1-phenyl-1-xylylethene, 1,1-ditolylethene, 1-tolyl-1-xylylethene, 1,1-dixylylethene, 1-(ethylphenyl)-1-phenylethene, 1-(ethylphenyl)-1-tolylethene, 1-(ethylmethylphenyl)-1-phenylethene, 1-(ethylphenyl)-1-xylylethene, 1-(ethylmethylphenyl)-1-tolylethene, 1-(diethylphenyl)-1-phenylethene, 1,1-bis(ethylphenyl) ethene, 1-phenyl-1-(n-propylphenyl) ethene, 1-phenyl-1-(isopropylphenyl) ethene, 1-(n-propylphenyl)-1-tolylethene, 1-(isopropylphenyl)-1-tolylethene, 1-(methyl-n-propylphenyl)-1-phenylethene, 1-(methyl isopropylphenyl)-1-phenylethene, 1-(n-butylphenyl)-1-phenylethene, 1-(isobutylphenyl)-1-phenylethene, 1-(sec-butylphenyl)-1-phenylethene and 1-(tert-butylphenyl)-1-phenylethene;

hydrocarbon compounds having an ethenylene group (vinylene group), such as 1,2-diphenylethene, 1-phenyl-2-tolylethene, 1-phenyl-2-xylylethene, 1,2-ditolylethene, 1-tolyl-2-xylylethene, 1,2-dixylylethene, 1-(ethylphenyl)-2-phenylethene, 1-(ethylphenyl)-2-tolylethene, 1-(ethylmethylphenyl)-2-phenylethene, 1-(ethylphenyl)-2-xylylethene, 1-(ethylmethylphenyl)-2-tolylethene, 1-(diethylphenyl)-2-phenylethene, 1,2-bis(ethylphenyl) ethene, 1-phenyl-2-(n-propylphenyl) ethene, 1-phenyl-2-(isopropylphenyl) ethene, 1-(n-propylphenyl)-2-tolylethene, 1-(isopropylphenyl)-2-tolylethene, 1-(methyl-n-propylphenyl)-2-phenylethene, 1-(methyl isopropylphenyl)-2-phenylethene, 1-(n-butylphenyl)-2-phenylethene, 1-(isobutylphenyl)-2-phenylethene, 1-(sec-butylphenyl)-2-phenylethene and 1-(tert-butylphenyl-2-phenylethene;

hydrocarbon compounds having a methylethenylene group, such as 1,2-diphenylpropene, 1-phenyl-2-tolylpropene, 1-phenyl-2-xylylpropene, 1,2-ditolylpropene, 1-tolyl-2-xylylpropene, 1-(ethylphenyl)-2-phenylpropene, 1-(ethylphenyl)-2-tolylpropene, 1-(ethylmethylphenyl)-2-phenylpropene, 1-phenyl-2-(n-propylphenyl) propene, 1-phenyl-2-(isopropylphenyl) propene, 2-phenyl-1-tolyl propene, 2-phenyl-1-xylylpropene, 2-tolyl-1-xylylpropene, 2-(ethylphenyl)-1-phenylpropene, 2-(ethylphenyl)-1-tolylpropene, 2-(ethylmethylphenyl)-1-phenylpropene, 2-phenyl-1-(n-propylphenyl) propene and 2-phenyl-1-(isopropylphenyl) propene;

hydrocarbon compounds having a propenylene group, such as 1,3-diphenylpropene, 1-phenyl-3-tolylpropene, 1-phenyl-3-xylylpropene, 1,3-ditolylpropene, 1-tolyl-3-xylylpropene, 1-(ethylphenyl)-3-phenylpropene, 1-(ethylphenyl)-3-tolylpropene, 1-(ethylmethylphenyl)-3-phenylpropene, 1-phenyl-3-(n-propylphenyl) propene, 1-phenyl-3-(isopropylphenyl) propene, 3-phenyl-1-tolyl propene, 3-phenyl-1-xylylpropene, 3-tolyl-1-xylylpropene, 3-(ethylphenyl)-1-phenylpropene, 3-(ethylphenyl)-1-tolylpropene, 3-(ethylmethylphenyl)-1-phenylpropene, 3-phenyl-1-(n-propylphenyl) propene and 3-phenyl-1-(isopropylphenyl) propene;

hydrocarbon compounds having a methylene ethylene group, such as 2,3-diphenylpropene, 2-phenyl-3-tolylpropene, 2-phenyl-3-xylylpropene, 2,3-ditolylpropene, 2-tolyl-3-xylylpropene, 2-(ethylphenyl)-3-phenylpropene, 2-(ethylphenyl)-3-tolylpropene, 2-(ethylmethylphenyl)-3-phenylpropene, 3-phenyl-3-(n-propylphenyl) propene, 2-phenyl-3-(isopropylphenyl) propene, 3-phenyl-2-tolyl propene, 3--phenyl-2-xylylpropene, 3-tolyl-2-xylylpropene, 3-(ethylphenyl)-2-phenylpropene, 3-(ethylphenyl)-2-tolylpropene, 3-(ethylmethylphenyl)-2-phenylpropene, 3-phenyl-2-(n-propylphenyl) propene and 3-phenyl-2-(isopropylphenyl) propene;

hydrocarbon compounds having a 3-methylpropenylene group, such as 1,3-diphenylbutene, 1-phenyl-3-tolylbutene, 1-phenyl-3-xylylbutene, 1-(ethylphenyl)-3-phenylbutene, 1,3-ditolylbutene, 3-phenyl-1-tolylbutene, 3-phenyl-1-xylylbutene and 3-(ethylphenyl)-1-phenylbutene;

hydrocarbon compounds having a 3-ethylpropenylene group, such as 1,3-diphenylpentene, 1-phenyl-3-tolylpentene and 3-phenyl-1-tolylpentene;

hydrocarbon compounds having a 1-methyl-3-methylenepropenylene group, such as 2,4-diphenylpentene, 2-phenyl-4-tolylpentene and 4-phenyl-2-tolylpentene;

hydrocarbon compounds having a 1,3-dimethylpropenylene group, such as 2,4-diphenyl-2-pentene, 2-phenyl-4-tolyl-2-pentene and 4-phenyl-2-tolyl-2-pentene;

hydrocarbon compounds having a 2,3-dimethylpropenylene group, such as 2-methyl-1,3-diphenylbutene, 2-methyl-1-phenyl-3-tolylbutene and 2-methyl-3-phenyl-1-tolylbutene;

hydrocarbon compounds having a 3,3-dimethylpropenylene group, such as 3-methyl-1,3-diphenylbutene, 3-methyl-1-phenyl-3-tolylbutene and 3-methyl-3-phenyl-1-tolylbutene; and hydrocarbon compounds having an alkenylene group having six carbon atoms, such as 2,4-diphenylhexene, 2,4-diphenyl-2-hexene, 2-methyl-1,3-diphenylpentene, 4-methyl-2,4-diphenylpentene, 4-methyl-2,4-diphenyl-2-pentene and 2,3-dimethyl-1,3-diphenylbutene.

Among the hydrocarbon compounds of the formula (1) according to this invention, preferable ones are such that a total number of carbon atoms of R, $R^1$, $R^2$, $R^3$ and $R^4$ in the formula is from 1 to 6, and $R^1$, $R^2$, $R^3$ and $R^4$ are selected from a hydrogen atom, methyl, ethyl, isopropyl and sec-butyl groups with the proviso that at least two of the $R^1$, $R^2$, $R^3$ and $R^4$ are hydrogen atoms.

The most preferable hydrocarbon compounds include:

(1) Hydrocarbon compounds of the formula (1) wherein R is an alkylene or alkenylene having 1 to 3 carbon atoms, a total number of carbon atoms of R, $R^1$, $R^2$, $R^3$ and $R^4$ is within a range of 1 to 6, and $R^1$, $R^2$, $R^3$ and $R^4$ are selected from a hydrogen atom, methyl, ethyl, isopropyl and sec-butyl groups with the proviso that at least two of the $R^1$, $R^2$, $R^3$ and $R^4$ are hydrogen atoms; or (2) Hydrocarbon compounds of the formula (1) wherein R is an alkylene or alkenylene having 4 to 6 carbon atoms, and $R^1$, $R^2$, $R^3$ and $R^4$ are each a hydrogen atom.

Typical of the most preferable hydrocarbon compounds of the formula (1) are:

hydrocarbon compounds having a methylene group such as diphenylmethane, phenyltolylmethane, phenylxylylmethane, ditolylmethane, (ethylphenyl) phenylmethane, (ethylphenyl) tolylmethane, (ethylmethylphenyl) phenylmethane, (diethylphenyl)

phenylmethane, bis(ethylphenyl) methane, phenyl (isopropylphenyl) methane, (isopropylphenyl) tolylmethane, (methyl isopropylphenyl) phenylmethane, (ethyl isopropylphenyl) phenylmethane, (ethylphenyl) (isopropylphenyl) methane, (sec-butylphenyl) phenylmethane, (sec-butylmethylphenyl) phenylmethane and (sec-butylphenyl) tolylmethane;

hydrocarbon compounds having a methylmethylene group (ethylidene group) such as 1,1-diphenylethane. 1-phenyl-1-tolylethane, 1-phenyl-1-xylylethane, 1,1-ditolylethane. 1-(ethylphenyl)-1-phenylethane, 1-(ethylphenyl)-1-tolylethane, 1-(ethylmethylphenyl)-1-phenylethane, 1-(diethylphenyl)-1-phenylethane, 1,1-bis(ethylphenyl) ethane, 1-phenyl-1-(isopropylphenyl) ethane, 1-(isopropylphenyl)-1-tolylethane, 1-(methyl isopropylphenyl)-1-phenylethane, and 1-(sec-butylphenyl)-1-phenylethane;

hydrocarbon compounds having an ethylene group such as 1,2-diphenylethane, 1-phenyl-2-tolylethane, 1-phenyl-2-xylylethane, 1,2-ditolylethane, 1-(ethylphenyl)-2-phenylethane, 1-(ethylphenyl)-2-tolylethane, 1-(ethylmethylphenyl)-2-phenylethane, 1-(diethylphenyl)-2-phenylethane, 1,2-bis (ethylphenyl) ethane, 1-phenyl-2-(n-propylphenyl) ethane, 1-(isopropylphenyl)-2-tolylethane, 1-(methyl isopropylphenyl)-2-phenylethane and 1-(sec-butylphenyl)-2-phenylethane;

hydrocarbon compounds having an ethylmethylene group (propylidene group) such as 1,1-diphenylpropane, 1-phenyl-1-tolylpropane, 1-phenyl-1-xylylpropane. 1,1-ditolylpropane, 1-(ethylphenyl)- 1-phenylpropane, 1-(ethylphenyl)-1-tolylpropane, 1-(ethylmethylphenyl)-1-phenylpropane and 1-phenyl-1-(isopropylphenyl) propane;

hydrocarbon compounds having a dimethylmethylene group (isopropylidene) such as 2,2-diphenylpropane, 2-phenyl-2-tolylpropane, 2-phenyl-2-xylylpropane, 2,2-ditolylpropane, 2-(ethylphenyl)-2-phenylpropane, 2-(ethylphenyl)-2-tolylpropane, 2-(ethylmethylphenyl)-2-phenylpropane and 2-phenyl-2-(isopropylphenyl) propane;

hydrocarbon compounds having an alkylene group having four carbon atoms such as 1,3-diphenylbutane;

hydrocarbon compounds having an alkylene group having five carbon atoms such as 1,3-diphenylpentane, 2,4-diphenylpentane, 2-methyl-1,3-diphenylbutane and 3-methyl-1,3-diphenylbutane;

hydrocarbon compounds having an alkylene group having six carbon atoms such as 2,4-diphenylbutane, 2-methyl-1,3-diphenylpentane, 2-methyl-2,4-diphenylpentane and 2,3-dimethyl-1,3-diphenylbutane;

hydrocarbon compounds having a vinylidene group such as 1,1-diphenylethene, 1-phenyl-1-tolylethene, 1-phenyl-1-xylylethene, 1,1-ditolylethene, 1-(ethylphenyl)-1-phenylethene, 1-(ethylphenyl)-1-tolylethene, 1-(ethylmethylphenyl)- 1-phenylethene, 1-(diethylphenyl)-1-phenylethene, 1,1-bis (ethylphenyl)ethene, 1-phenyl-1-(isopropylphenyl) ethene, 1-(isopropylphenyl)-1-tolylethene, 1-(methyl isopropylphenyl)-1-phenylethene and 1-(sec-butylphenyl)-1-phenylethene;

hydrocarbon compounds having an ethenylene group (vinylene group) such as 1,2-diphenylethene, 1-phenyl-2-tolylethene, 1-phenyl-2-xylylethene, 1,2-ditolylethene, 1-(ethylphenyl)-2-phenylethene, 1-(ethylphenyl)-2-tolylethene, 1-(ethylmethylphenyl)-2-phenylethene, 1-(diethylphenyl)-2-phenylethene, 1,2-bis(ethylphenyl) ethene, 1-phenyl-2-(isopropylphenyl) ethene, 1-(isopropylphenyl)-2-tolylethene, 1-(methyl isopropylphenyl)-2-phenylethene and 1-(sec-butylphenyl)-2-phenylethene;

hydrocarbon compounds having a methylethenylene group such as 1,2-diphenylpropene, 1-phenyl-2-tolylpropene, 1-phenyl-2-xylylpropene, 1,2-ditolylpropene, 1-(ethylphenyl)-2-phenylpropene, 1-(ethylphenyl)-2-tolylpropene, 1-(ethylmethylphenyl) -2-phenylpropene, 1-phenyl-2-(isopropylphenyl) propene, 2-phenyl-1-tolylpropene, 2-phenyl-1-xylylpropene, 2-(ethylphenyl)-1-phenylpropene, 2-(ethylphenyl)-1-tolylpropene, 2-(ethylmethylphenyl) -1-phenylpropene and 2-phenyl-1-(isopropylphenyl) propene;

hydrocarbon compounds having a propenylene group such as 1,3-diphenylpropene, 1-phenyl-3-tolylpropene, 1-phenyl-3-xylylpropene, 1,3-ditolylpropene, 1-(ethylphenyl)-3-phenylpropene, 1-(ethylphenyl)-3-tolylpropene, 1-(ethylmethylphenyl)-3-phenylpropene, 1-phenyl-3-(isopropylphenyl) propene, 3-phenyl-1-tolylpropene, 3-phenyl-1-xylylpropene, 3-(ethylphenyl)-1-phenylpropene, 3-(ethylphenyl-1-tolylpropene, 3-(ethylmethylphenyl)-1-phenylpropene and 3-phenyl-1-(isopropylphenyl) propene;

hydrocarbon compounds having a methyleneethylene group such as 2,3-diphenylpropene, 2-phenyl-3-tolylpropene, 2-phenyl-3-xylylpropene, 2,3-ditolylpropene, 2-(ethylphenyl)-3-phenylpropene, 2-(ethylphenyl)-3-tolylpropene, 2-(ethylmethylphenyl)-3-phenylpropene, 2-phenyl-3-(isopropylphenyl) propene, 3-phenyl-2-tolyl propene, 3-phenyl-2-xylylpropene, 3-(ethylphenyl)-2-phenylpropene, 3-(ethylphenyl)-2-tolylpropene, 3-(ethylmethylphenyl)-2-phenylpropene and 3-phenyl-2-(isopropylphenyl) propene;

hydrocarbon compounds having an alkenylene group having four carbon atoms such as 1,3-diphenylbutene;

hydrocarbon compounds having an alkenylene group having five carbon atoms such as 1,3-diphenylpentene, 2,4-diphenylpentene, 2,4-diphenyl-2-pentene, 2-methyl-1,3-diphenylbutene and 3-methyl-1,3-diphenylbutene; and hydrocarbon compounds having an alkenylene group having six carbon atoms such as 2,4-diphenylhexene, 2,4-diphenyl-2-hexene, 2-methyl-1,3-diphenylpentene, 4-methyl-2,4-diphenylpentene, 4-methyl-2,4-diphenyl-2-pentene and 2,3-dimethyl-1,3-diphenylbutene.

The hydrocarbon compounds represented by the general formula (1) can be manufactured by any one selected from suitable conventional methods such as those explained below.

For example, the hydrocarbon compounds represented by the general formula (1) can be obtained by attaching styrene or a styrene compound such as α- or β-methylstyrene or ethylstyrene to an alkylbenzene in the presence of an acid catalyst. The acid catalysts useful in this case include a mineral acid such as sulfuric or phosphoric acid; a solid acidic substance such as acid clay or activated clay; and Friedel-Crafts catalyst which is a metal halide.

Furthermore, the hydrocarbon compounds represented by the general formula (1) can also be obtained by the polymerization reaction of styrene or styrene compounds mentioned above in the presence of a suitable acid catalyst. In this case, a single styrene compound can be employed, or at least two kinds of styrene compounds may be employed so as to co-polymerize them. The acid catalysts useful in this case are as illustrated above. The hydrocarbon compounds obtained by this method are generally those wherein a couple of benzene rings are linked via an alkenylene group. According to this invention, these compounds may be employed as they are, or after their alkenylene group is subjected to a hydrogenation treatment in the presence of a suitable catalyst so as to convert the alkenylene group into an alkylene group.

With respect to the alkylation of an aromatic compound, the utilization of Friedel-Crafts reaction is well known. It is also possible to utilize this Friedel-Crafts reaction in the manufacture of the hydrocarbon compounds of this invention. For example, the hydrocarbon compounds represented by the general formula (1) can also be manufactured by reacting an alkylbenzene having a chlorinated alkyl side chain group with benzene or an alkylbenzene in the presence of a suitable Friedel-Crafts catalyst such as a metal halide. Further, an alkane dihalide may be subjected to a coupling reaction with benzene or an alkylbenzene in the presence of a suitable Friedel-Crafts catalyst such as a metal halide to obtain the hydrocarbon compounds.

Furthermore, it is also possible to manufacture the hydrocarbon compounds represented by the general formula (1) by using an alkylbenzene having alkyl groups represented by the afore-mentioned $R^1$, $R^2$, $R^3$ and $R^4$ in the above-mentioned reactions. Alternatively, the hydrocarbon compounds manufactured by the above-mentioned method may subsequently have the alkyl groups represented by the afore-mentioned $R^1$, $R^2$, $R^3$ and $R^4$ addition reacted therewith by any suitable method.

The general formulas (2) and (3) are explained below in more detail.

If at least one of $R^6$, $R^7$, $R^8$ and $R^9$ is a hydrocarbon group having at least 11 carbon atoms or if the total number of carbon atoms of $R^6$, $R^7$, $R^8$ and $R^9$ is at least 11, then the compatibility of the hydrocarbon compound with a HFC refrigerant would undesirably be deteriorated.

$R^6$, $R^7$, $R^8$ and $R^9$ in these general formulas (2) and (3) may be the same or different and are each a hydrogen atom or a hydrocarbon group having 1 to 10, preferably 1 to 8, carbon atoms. The hydrocarbon group may be selected for example from an alkyl group, alkenyl group, aryl group, alkaryl group or aralkyl group.

Preferable hydrocarbon groups represented by $R^6$, $R^7$, $R^8$ and $R^9$ in the general formulas (2) and (3) include:

an alkyl group having 1 to 8 carbon atoms, such as methyl, ethyl, n-propyl, isopropyl, butyl of straight chain or branched chain type, pentyl of straight chain or branched chain type, hexyl of straight chain or branched chain type, heptyl of straight chain or branched chain type and octyl of straight chain or branched chain type;

an alkenyl group having 2 to 8 carbon atoms, such as ethenyl (vinyl), ethyl, n-propyl, isopropyl, butyl of straight chain or branched chain type, pentyl of straight chain or branched chain type, hexyl of straight chain or branched chain type, heptyl of straight chain or branched chain type and octyl of straight chain or branched chain type;

an aryl or alkaryl group having 6 to 8 carbon atoms, such as phenyl, tolyl, xylyl, ethylphenyl and vinylphenyl: and an aralkyl group having 7 to 8 carbon atoms, such as benzyl, 1-phenylethyl and 2-phenylethyl (phenethyl).

Among these hydrocarbon groups, an alkyl group having 1 to 8 carbon atoms and an alkenyl group having 2 to 8 carbon atoms are particularly preferable. Among these preferable groups, branched chain type thereof is the most preferable.

A total number of carbon atoms of $R^6$, R, $R^7$, $R^8$ and $R^9$ in the general formulas (2) and (3) should be in the range of 1 to 10, preferably 1 to 8. If the total number of carbon atoms is within this range, then $R^6$, $R^7$, $R^8$ and $R^9$ may be the same or different. Namely, all of $R^6$, $R^7$, $R^8$ and $R^9$ may be a hydrocarbon group, or at least one of $R^6$, $R^7$, $R^8$ and $R^9$ may be a hydrocarbon group while the rest thereof may be a hydrogen atom. In view of the compatibility of the hydrocarbon compound with a refrigerant, it is preferable that 1 to 3 of $R^6$, $R^7$, $R^8$, $R^8$ and $R^9$ are a hydrocarbon group while the rest thereof are a hydrogen atom and that the total number of carbon atoms of $R^6$–$R^9$ is within a range of 3 to 8.

When two out of $R^6$, $R^7$, $R^8$ and $R^9$ are a hydrocarbon group, the combination of $R^6$, $R^7$, $R^8$ and $R^9$ may be arbitrarily selected. A couple of hydrocarbon groups may be attached to the same benzene ring (condensed ring) as in the case where $R^6$ and $R^7$ are respectively hydrocarbon groups. Alternatively, a single hydrocarbon group may be attached to each of different benzene rings (condensed rings) as in the case where $R^6$ and $R^8$ are respectively hydrocarbon groups.

Preferable hydrocarbon compounds represented by the general formula (2) according to this invention include (n-propyl) biphenyl, isopropylbiphenyl, (n-butyl) biphenyl, isobutylbiphenyl, (sec-butyl) biphenyl, (tert-butyl) biphenyl, (sec-pentyl) biphenyl, (1-ethylpropyl) biphenyl, (tert-pentyl) biphenyl, (1-methylpentyl) biphenyl, (1-ethylbutyl) biphenyl, (1,1-dimethylbutyl) biphenyl, (1-ethyl-1-methylpropyl) biphenyl, (1-methylhexyl) biphenyl, (1-ethylpentyl) biphenyl, (1-propylbutyl) biphenyl, (1,1-dimethylpentyl) biphenyl, (1-ethyl-1-methylbutyl) biphenyl, (1,1-diethylpropyl) biphenyl, (1-methylheptyl) biphenyl, (1-ethylhexyl) biphenyl, (1-propylpentyl) biphenyl, (1,1-dimethylhexyl) biphenyl, (1-ethyl-1-methylpentyl) biphenyl, (1-methyl-1-propylbutyl) biphenyl, (1,1-diethylbutyl) biphenyl, ethylmethylbiphenyl, diethyl biphenyl, methyl (n-propyl) biphenyl, methylisopropyl biphenyl, di(n-propyl) biphenyl, diisopropylbiphenyl, (n-butyl) methylbiphenyl, isobutylmethylbiphenyl, (sec-butyl) methylbiphenyl, (tert-butyl) methyl biphenyl, di(n-butyl) biphenyl, diisobutylbiphenyl, di(sec-butyl) biphenyl, di(tert-butyl) biphenyl, trimethylbiphenyl, triethylbiphenyl, ethyldimethyl biphenyl, diethylmethylbiphenyl, dimethyl (n-propyl) biphenyl, dimethylisopropylbiphenyl, methyldi (n-propyl) biphenyl, methyldiisopropylbiphenyl, (n-butyl) dimethylbiphenyl, isobutyldimethylbiphenyl, (sec-butyl) dimethylbiphenyl, (tert-butyl) dimethyl biphenyl, phenylbiphenyl, tolylbiphenyl, xylyl biphenyl, (ethylphenyl) biphenyl, (vinylphenyl) biphenyl, benzylbiphenyl, phenethylbiphenyl and (1-phenylethyl) biphenyl.

Preferable hydrocarbon compounds represented by the general formula (3) according to this invention include (n-propyl) naphthalene, isopropylnaphthalene, (n-butyl) naphthalene, isobutylnaphthalene, (sec-butyl) naphthalene, (tert-butyl) naphthalene, (sec-pentyl) naphthalene, (1-ethylpropyl) naphthalene, (tert-pentyl) naphthalene, (1-methylpentyl) naphthalene, (1-ethylbutyl) naphthalene, (1,1-dimethylbutyl) naphthalene, (1-ethyl-1-methylpropyl) naphthalene, (1-methylhexyl) naphthalene, (1-ethylpentyl) naphthalene. (1-propylbutyl) naphthalene, (1,1-dimethylpentyl) naphthalene, (1-ethyl-1-methylbutyl)

naphthalene, (1,1-diethylpropyl) naphthalene, (1-methylheptyl) naphthalene, (1-ethylhexyl) naphthalene, (1-propylpentyl) naphthalene, (1,1-dimethylhexyl) naphthalene, (1-ethyl-1-methylpentyl) naphthalene, (1-methyl-1-propylbutyl) naphthalene, (1,1-diethylbutyl) naphthalene, ethylmethylnaphthalene, diethyl naphthalene, methyl (n-propyl) naphthalene, methyl isopropylnaphthalene, di(n-propyl) naphthalene, diisopropylnaphthalene, (n-butyl) methylnaphthalene, isobutylmethylnaphthalene, (sec-butyl) methyl naphthalene, (tert-butyl) methylnaphthalene, di(n-butyl) naphthalene, diisobutylnaphthalene, di(sec-butyl) naphthalene, di(tert-butyl) naphthalene, trimethylnaphthalene, triethylnaphthalene, ethyl dimethylnaphthalene, diethylmethylnaphthalene, dimethyl (n-propyl) naphthalene, dimethylisopropyl naphthalene, methyl di(n-propyl) naphthalene, methyl diisopropylnaphthalene, (n-butyl) dimethyl naphthalene, isobutyldimethylnaphthalene, (sec-butyl) dimethylnaphthalene, (tert-butyl) dimethyl naphthalene, phenylnaphthalene, tolylnaphthalene, xylylnaphthalene. (ethylphenyl) naphthalene, (vinylphenyl) naphthalene, benzylnaphthalene, phenethylnaphthalene and (1-phenylethyl) naphthalene.

The hydrocarbon compounds represented by the general formulas (2) and (3) can be manufactured by any of conventional methods. For example, these hydrocarbon compounds can be obtained by attaching (or addition reacting) compounds selected from the group consisting of halides of hydrocarbon having 1 to 10 carbon atoms, olefins having 2 to 10 carbon atoms and styrene and styrene-based compounds having 8 to 10 carbon atoms to (or with) biphenyl and naphthalene in the presence of a mineral acid such as sulfuric acid, phosphoric acid, tungstosilicic acid or hydrofluoric acid; a solid acidic substance such as acid clay or activated clay; or a Friedel-Crafts catalyst which is a metal halide such as aluminum chloride or zinc chloride.

The refrigerating machine oil of this invention may be employed as far as it comprises at least one member selected from the group consisting of hydrocarbon compounds represented by the general formulas (1), (2) and (3), it may also comprise the hydrocarbon compounds having a single structure or it may comprise a mixture of the hydrocarbon compounds having different structures as far as these different compounds are represented by the general formulas (1), (2) and (3). Furthermore, in a case where the refrigerating machine oil comprises the hydrocarbon compounds as a mixture thereof, there may be employed the hydrocarbon compounds represented by the general formula (1) alone, by the general formula (2) alone, by the general formula (3) alone or by at least two of the general formulas (1) to (3).

There is not any particular restriction on the viscosity of the hydrocarbon compounds used as a refrigerating machine oil. However, it is preferable to make selective use of the hydrocarbon compounds having a kinematic viscosity of preferably 2 to 30 $mm^2/s$ at a temperature of 40° C., more preferably 2.3 to 20 $mm^2/s$. It is preferable that the hydrocarbon compounds have a kinematic viscosity of 3 to 15 $mm^2/s$ in order to enable them to improve refrigerators in wear resistance.

There may be suitably determined the content of the hydrocarbon compounds of the formulas (1) to (3) in the refrigerating machine oil of this invention. However, the content of these hydrocarbon compounds should preferably be in the range of 50 to 100% by weight, more preferably 70 to 100% by weight and most preferably 80 to 100% by weight based on the total amount of the refrigerating machine oil.

The refrigerating machine oil of this invention when actually used as such, may additionally contain, for the purpose of controlling its viscosity, lubricity and the like, not more than 50% by weight, preferably not more than 30% by weight and more preferably not more than 20% by weight of other aromatic hydrocarbon compounds based on the total mass of the refrigerating machine oil as far as the viscosity of the resulting mixed oil is within a range of the above-mentioned vicosity. Other such aromatic hydrocarbon compounds include a branched alkylbenzene, a straight-chain alkylbenzene or a compound represented by the following general formulas (4) to (7);

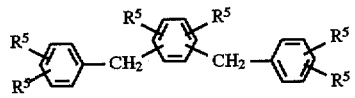
(4)

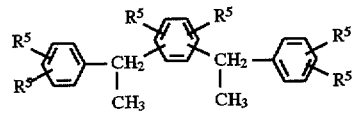
(5)

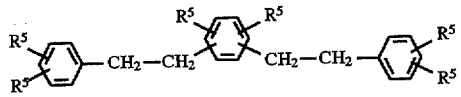
(6)

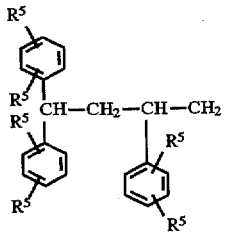
(7)

wherein $R^5$ in all of these general formulas (4) to (7) represents a hydrogen atom or alkyl group having 1 to 4 carbon atoms, and $R^5$ may be the same or different in the same molecule.

These aromatic hydrocarbon compounds may be added to the hydrocarbon compounds of this invention, or they may be contained therein as by-products produced in the case of manufacture of the hydrocarbon compounds of the formula (1) of this invention.

The refrigerating machine oil of this invention comprises at least one compound represented by any of the above general formulas (1) to (3), and may be used with a HFC refrigerant without including any additives. However, it is also possible to blend the refrigerator oil with various kinds of additives if required.

In order to improve the refrigerating machine oil in wear resistance and load resistance, it is preferable to blend the refrigerator oil with at least one kind of phosphorus compound selected from the group consisting of phosphoric esters, acidic phosphoric esters, amine salts of acidic phosphoric esters, chlorinated phosphoric esters and phosphorous esters.

These phosphorus compounds are esters obtained by reacting phosphoric acid or phosphorous acid with an alkanol or a polyether type alcohol or are derivatives of the esters.

Phosphoric esters used herein include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylyl phosphate, cresyldiphenyl phosphate and xylldiphenyl phosphate.

Acidic phosphoric esters used herein include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dioctadecyl acid phosphate and dioleyl acid phosphate. Examples of amine salt of acidic phosphoric ester are methyl amine, ethyl amine, propyl amine, butyl amine, pentyl amine, hexyl amine, heptyl amine, octyl amine, dimethyl amine, diethyl amine, dipropyl amine, dibutyl amine, dipentyl amine, dihexyl amine, diheptyl amine, dioctyl amine, trimethyl amine, triethyl amine, tripropyl amine, tributyl amine, tripentyl amine, trihexyl amine, triheptyl amine and trioctyl amine of the acidic phosphoric ester. Chlorinated phosphoric esters include tris-dichloropropyl phosphate, tris-chloroethyl phosphate, tris-chlorophenyl phosphate and polyoxyalkylene bis[di(chloroalkyl)]phosphate. Examples of phosphorous ester are dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. It is also possible to use a mixture of these compounds.

These phosphorus compounds can be generally incorporated in any desired ratio in the refrigerating machine oil of this invention. However, it is generally preferable to incorporate them in the refrigerator oil in a ratio of preferably 0.01 to 5.0% by mass, more preferably 0.02 to 3.0% by mass based on the total amount of the resulting mixed refrigerating machine oil (the total amount of hydrocarbon compounds of this invention and, if required, branched alkylbenzenes, straight-chain alkylbenzenes, aromatic compounds represented by the general formulas (4) to (7), and the whole additives).

In order to improve the refrigerator of this invention in stability, it is also possible to incorporate in the refrigerator oil at least one kind of an epoxy compound selected from the group consisting of:

(1) Phenylglycidyl ether type epoxy compounds, (2) Alkylglycidyl ether type epoxy compounds, (3) Glycidyl ester type epoxy compounds, (4) Aryl oxirane compounds, (5) Alkyl oxirane compounds, (6) Alicyclic epoxy compounds, (7) Epoxidized fatty monoesters and (8) Epoxidized vegetable oils.

The phenylglycidyl ether type epoxy compounds (1) include phenylglycidyl ether and alkylphenylglycidyl ether. The alkylphenylglycidyl ether used herein may be one having 1 to 3 alkyl groups each containing 1 to 13 carbon atoms, preferably one having one alkyl group containing to 10 carbon atoms. The preferable alkylphenylglycidyl ethers include n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

The alkylglycidyl ether type epoxy compounds (2) include decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexadiol diglycidyl ether, sorbitol polyglycidyl ether, polyalkyleneglycol monoglycidyl ether and polyalkyleneglycol diglycidyl ether.

The glycidyl ester type epoxy compounds (3) include phenylglycidyl ester, alkylglycidyl ester and alkenylglycidyl ester. The preferable compounds (3) include glycidyl 2,2-dimethyloctanoate, glycidyl benzoate, glycidyl acrylate and glycidyl methacrylate.

The aryl oxirane compounds (4) include 1,2-epoxystyrene and alkyl-1,2-epoxystyrene.

The alkyl oxirane compounds (5) include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,2-epoxyoctadecane, 1,2-epoxynonadecane and 1,2-epoxyeicosane.

The alicyclic epoxy compounds (6) include 1,2-epoxycyclohexane, 1,2-epoxycyclopentane, 3,4-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo[4.1.0]hept-3-yl)-spiro(1,3-dioxane-5,3'-[7]oxabicyclo[4.1.0])heptane, 4-(1'-methylepoxyethyl)-1,2-epoxy-2-methylcyclohexane and 4-epoxyethyl-1,2-epoxycyclohexane.

The epoxidized fatty monoesters (7) include an ester formed through a reaction between an epoxidized fatty acid having 12 to 20 carbon atoms and an alcohol having 1 to 8 carbon atoms, phenol or an alkylphenol. In particular, epoxystearates such as butyl, hexyl, benzyl, cyclohexyl, methoxyethyl, phenyl and butylphenyl esters of epoxystearic acid are preferred.

The epoxidized vegetable oils (8) include epoxy compounds of a vegetable oil such as soybean oil, linseed oil or cottonseed oil.

Among these epoxy compounds, phenylglycidyl ether type epoxy compounds, glycidyl ester type epoxy compounds and epoxidized fatty monoester are preferred with phenylglycidyl ether type epoxy compounds and glycidyl ester type epoxy compounds being more preferred and phenylglycidyl ether, butylphenylglycidyl ether, alkylglycidyl esters and a mixture thereof being the most preferred.

These epoxy compounds may be incorporated in the refrigerating machine oil in any desired mixing ratio. However, it is generally preferable to incorporate therein these epoxy compounds in the ratio of 0.1 to 5.0% by weight, more preferably 0.2 to 2.0% by weight, based on the total amount of the refrigerating machine oil composition (the total amount of the hydrocarbon compounds of this invention and, if required, branched alkylbenzenes, straight-chain alkylbenzenes, aromatic compounds represented by the general formulas (4) to (7), and the whole additives).

It is of course possible to employ these phosphorus compounds and epoxy compounds jointly.

It is also possible, if required, to use singly or jointly suitable conventional additives for the refrigerating machine oil for the purpose of improving the oil in properties. The suitable conventional additives include anti-oxidants of phenol type such as di-tert-butyl-p-cresol and bisphenol A or of an amine type such as phenyl-α-naphthyl amine and N,N-di(2-naphthyl)-p-phenylene diamine; wear resistant additives such as zinc dithiophosphate; extreme pressure agents such as chlorinated paraffin and sulfur compounds; oiliness improvers such as a fatty acid; anti-foaming agents such as silicone-type ones; metal inactivators such as benzotriazole; viscosity index improvers; pour point depressants; and detergent-dispersants. These additives may be used singly or in combination. These additives can be generally added in a ratio of not more than 10% by weight, more preferably not more than 5% by weight, based on the total amount of the refrigerating machine oil composition (the total amount of hydrocarbon compounds of this invention and, if required, branched alkylbenzenes, straight-chain alkylbenzenes, aromatic compounds represented by the general formulas (4) to (7), and the whole additives).

The hydrofluorocarbon (HFC) refrigerants used in a refrigerating machine together with the refrigerating machine oil of this invention, include hydrofluorocarbon having 1 to 3 carbon atoms, preferably 1 to 2 carbon atoms.

The HFC refrigerants include difluoromethane (HFC-32), trifluoromethane (HFC-23), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a) and a mixture of at least two kinds thereof.

These refrigerants are properly selected in accordance with use and performance thereof, and preferable HFC refrigerants useful in this invention are HFC-134a alone, HFC-125 alone, a mixture of HFC-134a/HFC-32 in a ratio of 60–80% by weight/40–20% by weight; a mixture of HFC-32/HFC-125 in a ratio of 40–70% by weight/60–30% by weight, a mixture of HFC-125/HFC-143a in a ratio of 40–60% by weight/60–40% by weight, a mixture of HFC-134a/HFC-32/HFC-125 in a ratio of 60% by weight/30% by weight/10% by weight, a mixture of HFC-134a/HFC-32/HFC-125 in a ratio of 40–70% by weight/15–35% by weight/5–40% by weight and a mixture of HFC-125/HFC-134a/HFC-143a in a ratio of 35–55% by weight/1–15% by weight/40–60% by weight.

More specifically, the HFC refrigerant mixtures include a mixture of HFC-134a/HFC-32 in a ratio of 70% by weight/30% by weight; a mixture of HFC-32/HFC-125 in a ratio of 60% by weight/40% by weight; a mixture of HFC-32/HFC-125 in a ratio of 50% by weight/50% by weight (R410A; trade name: Genetron AZ-20, a product of Allied-Signal Inc.); a mixture of HFC-32/HFC-125 in a ratio of 45% by weight/55% by weight (R410B; trade name: SUVA AC9100, a product of E. I. Dupont de Nemours and Company); a mixture of HFC-125/HFC-143a in a ratio of 50% by weight/50% by weight (R507C; trade name: Genetron AZ-50, a product of Allied-Signal Inc.); a mixture of HFC-32/HFC-125/HFC-134a in a ratio of 30% by weight/10% by weight/60% by weight; a mixture of HFC-32/HFC-125/HFC-134a in a ratio of 23% by weight/25% by weight/52% by weight (R407C; trade name: SUVA AC9000, a product of E. I. Dupont de Nemours and Company); and a mixture of HFC-125/HFC-134a/HFC-143a in a ratio of 44% by weight/4% by weight/52% by weight (R404A; trade name: SUVA HP-62, a product of E. I. Duppont de Nemours and Company).

The refrigerating machine oil of this invention is generally employed in a refrigerating machine as a fluid composition wherein the refrigerating machine oil is incorporated with a hydrofluorocarbon refrigerant as explained above. The mixing ratio between the refrigerating machine oil and the (hydrofluorocarbon) refrigerant in the fluid composition may be suitably determined, but the amount of the refrigerating machine oil used may generally be 1 to 500 parts by weight, preferably 2 to 400 parts by weight, per 100 parts by weight of the hydrofluorocarbon refrigerant.

Since the present refrigerating machine oil of this invention excellently meets various requirements such as its compatibility with the HFC refrigerant, electric properties, hydrolysis stability, lubricity and hygroscopicity, it is particularly suited for use in a refrigerating machine (cooling system) wherein hydrofluorocarbon is used as a refrigerant, such as an air conditioner or a refrigerator provided with a sealed compressor of a reciprocating type or rotary type. The present refrigerating machine oil is also preferably used in various refrigerating machine (cooling system) using hydrofluorocarbon as a refrigerant, such as an automotive air conditioner, a dehumidifier, a freezer, a freeze and refrigeration warehouse, an automatic vending machine, a showcase and a cooling system in a chemical plant. The present refrigerating machine oil is also applicable to a refrigerating machine (cooling system) provided with a compressor of centrifugal type using hydrofluorocarbon as a refrigerant.

The lubricating method of this invention is characterized in that the refrigerating machine oil of this invention can be employed as a lubricating oil in various cooling systems using hydrofluorocarbon as a refrigerant. There is no limitation on various conditions such as the amount of the lubricating oil supplied, and these conditions are suitably determined according to the type of cooling system.

The refrigerating machine oil of this invention generally circulates in the form of a fluid composition comprising a mixture of said oil and a hydrofluorocarbon refrigerant in the refrigerating machine. Therefore, the refrigerating machine of this invention is characterized in that the aforesaid fluid composition is employed as a circulating fluid. There is no limitation on the present refrigerating machine of this invention except that the fluid composition of this invention is used as a circulating fluid, so that the present refrigerating machine may be the same in structures as a conventional refrigerating machine. Since the refrigerating machine oil of this invention is excellent in compatibility with the HFC refrigerant, neither specific devices nor measures are required for separating the lubricating oil from the refrigerant.

DESCRIPTION OF THE PREFERRED EMBODIMENTS

EXAMPLES

The present invention will be better understood by the following Examples and Comparative Examples. It should be noted, however, that these Examples are not intended to restrict in any manner the scope of this invention.

Examples 1 to 6 and Comparative Examples 1 to 4

The refrigerating machine oils (sample oils) used in these Examples and Comparative Examples, and the kinematic viscosities thereof are shown in Table 1.

TABLE 1
| Oil | Kinematic viscosity ($mm^2/s$) 40° C. | 100° C. |
|---|---|---|
| Ex. 1 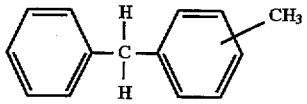 | 2.38 | 1.05 |
| Ex. 2 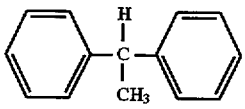 | 2.67 | 1.09 |
| Ex. 3 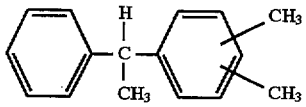 | 5.15 | 1.55 |
| Ex. 4 A mixture of: (weight %) 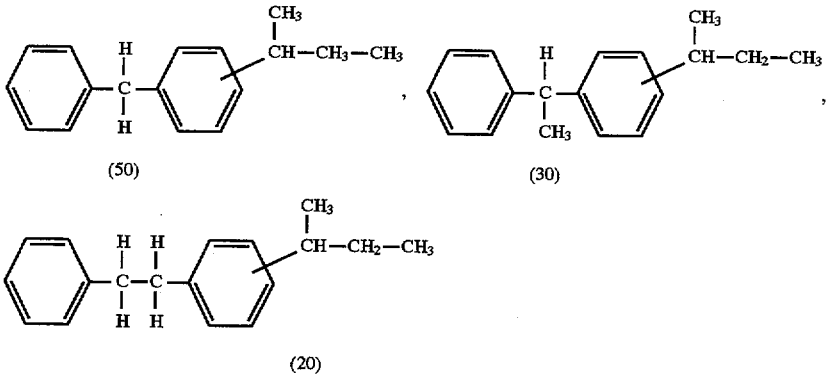 (50) (30) (20) | 4.65 | 1.57 |
| Ex. 5 A mixture of: (weight %; 87:13) 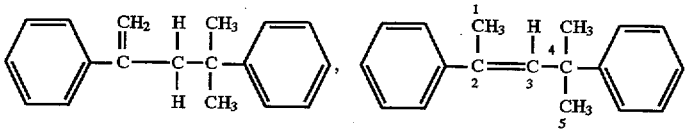 | 9.83 | 2.24 |
| Ex. 6 A mixture of: (weight %) 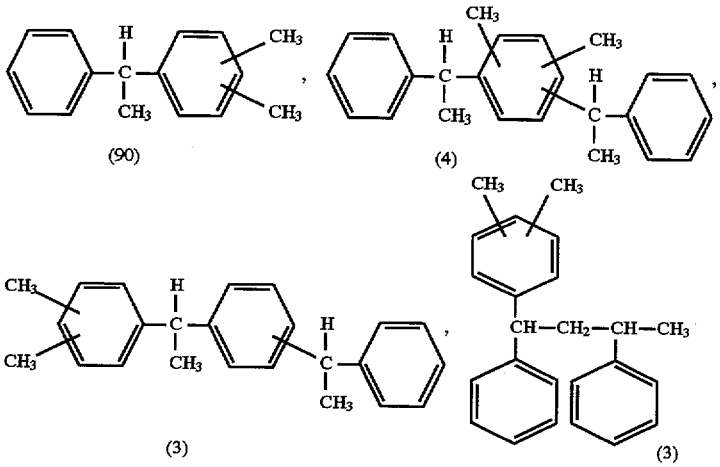 (90) (4) (3) (3) | 6.24 | 1.87 |

TABLE 1-continued

| Oil | Kinematic viscosity ($mm^2/s$) 40° C. | 100° C. |
|---|---|---|
| Comp. Ex. 1 Branched-type alkylbenzenes (average molecular weight = 260) | 8.31 | 2.08 |
| Comp. Ex. 2 Straight chain-type (average molecular weight = 240) | 4.31 | 1.44 |
| Comp. Ex. 3 Tetra-ester derived from pentaerythritol and ethylhexanoic acid | 45.1 | 6.28 |
| Comp. Ex. 4 polypropylene glycol monobutylether (average molecular weight = 690) | 32.5 | 6.71 |

The refrigerating machine oils of these Examples and Comparative Examples were evaluated for their compatibility with a refrigerant (HFC-134a), electric insulation (volume resistivity), hydrolytic stability and lubricity. The results are shown in Table 2. These evaluation tests were conducted as follows.

(1) Compatibility (Two-Phase Separation Temperature)

In conformity with JIS K 2211 4.12, the tests were conducted by incorporating 1.5 g of each of the sample oils of Examples and Comparative Examples into 48.5 g of a refrigerant (HFC-134a) (oil content: 3%) to see if the refrigerant and the sample oil would dissolve in each other, or if they would be separated from each other or turned into a white-turbid liquid, thereby to measure the lower limit value (two-phase separation temperature) where the refrigerant and the sample oil start to be insoluble in each other. The same tests as described above were also conducted on the compositions where 2.5 g of each of the sample oils of Examples and Comparative Examples were incorporated into 47.5 g of the refrigerant (oil content: 5%), so that the two-phase separation temperature of each of these compositions was measured.

(2) Electric Insulation (Volume Resistivity)

In conformity with JIS C 2101 4.12, there was measured the volume resistivity of each sample oils at a temperature of 25° C.

(3) Hydrolytic Stability 150 g of each sample oils of Examples and Comparative Examples and 0.15 g of water were introduced into a 200-ml heat resistant glass tube, and then 10 pieces of each of copper wires, iron wires and aluminum wires (1 mm in diameter and 100 mm in length) were introduced as a degradation-promoting catalyst into each of the glass tubes. Subsequently, each glass tube so charged was put in a stainless autoclave filled with a $N_2$ atmosphere and then kept therein at a temperature of 175° C. for 168 hours, so that each sample oil was thermally degraded. After the test, each sample oil was measured for its total acid number.

(4) Antiwear Property (Wear-Reducing Effect)

A rolling piston type compressor was filled with 50 g of refrigerant HFC-134a and 70 g of each of the sample oils and then operated for 1000 hours under the conditions of a delivery pressure of 16 $kgf/cm^2$ G, an inlet pressure of 0 $kgf/cm^2$ G, a revolving speed of 3000 rpm and a test temperature of 160° C. to measure the surface roughness of sliding surface portion of the compressor vanes after the end of the test.

TABLE 2

| Oil | Compatibilty with HFC-134a (Two-phase separation temp. °C.) Oil content 3% | Oil content 5% | Volume resistivity Ω · cm | Hydrolytic stability (total acid number after test) mgKOH/g | Antiwear property (average roughness) μm |
|---|---|---|---|---|---|
| Ex. 1 | −54 | −27 | $5.3 \times 10^{15}$ | 0.01 | 0.17 |
| Ex. 2 | −50 | −25 | $3.9 \times 10^{15}$ | 0.01 | 0.17 |
| Ex. 3 | −30 | −2 | $4.5 \times 10^{15}$ | 0.01 | 0.14 |
| Ex. 4 | −10 | 22 | $4.0 \times 10^{15}$ | 0.01 | 0.16 |
| Ex. 5 | −2 | 40 | $3.5 \times 10^{15}$ | 0.01 | 0.11 |
| Ex. 6 | −16 | 13 | $2.9 \times 10^{15}$ | 0.01 | 0.13 |
| Comp. Ex. 1 | >50 | >50 | $3.7 \times 10^{15}$ | 0.01 | 0.15 |
| Comp. Ex. 2 | >50 | >50 | $5.6 \times 10^{15}$ | 0.01 | 0.12 |
| Comp. Ex. 3 | <−70 | <−70 | $5.2 \times 10^{14}$ | 1.58 | 0.49 |
| Comp. Ex. 4 | <−70 | <−70 | $7.4 \times 10^{8}$ | 0.01 | 0.79 |

As is apparent from the results of tests on the oils of Examples and Comparative Examples shown in Table 2, it has been found that the refrigerating machine oils of Examples 1 to 6 of this invention were excellent in compatibility with the HFC refrigerant, electric insulation, hydrolysis stability and lubricity (wear resistance).

By contrast, it has been found that the refrigerating machine oils, which are alkylbenzene oils, of Comparative Examples 1 and 2 were excellent in electric insulating property, hydrolysis stability and lubricity, but they were very poor in compatibility with the HFC refrigerant. On the other hand, it has been found that the refrigerating machine oil, which is a tetra-ester of 2-ethyl hexanoic acid, of Comparative Example 3 (oxygen-containing oil) was excellent in compatibility with HFC refrigerant and electric insulation, but this comparative oil was poor in hydrolysis stability and lubricity. It has further been found that the refrigerating machine oil, which is polypropylene glycol monobutyl ether, of Comparative Example 4 (oxygen-containing oil) was excellent in compatibility with HFC refrigerant and hydrolysis stability, but this comparative oil was poor in electric insulation and lubricity, thereby to give rise to problems as to its actual use.

Examples 7 to 10

The refrigerating machine oils (sample oils) used in Examples 7 to 10, and the kinematic viscosies thereof are shown in Table 3.

TABLE 3

| Oil | | Kinematic viscosity ($mm^2/s$) 40° C. | 100° C. |
|---|---|---|---|
| Ex. 7 | 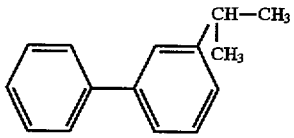 | 4.43 | 1.38 |
| Ex. 8 | 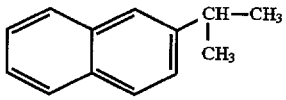 | 2.35 | 0.96 |
| Ex. 9 | 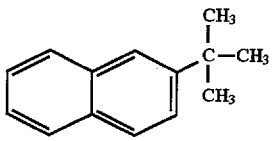 | 3.88 | 1.31 |
| Ex. 10 | 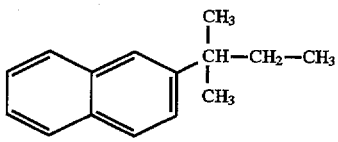 | 5.14 | 1.53 |

The refrigerating machine oils of these Examples were evaluated for their compatibility with a refrigerant (HFC-134a), electric insulation (Volume resistivity), hydrolytic stability and lubricity in the same manner as in Example 1. The results are shown in Table 4.

TABLE 4

| Oil | Compatibilty with HFC-134a (Two-phase separation temp. °C.) Oil content 3% | Oil content 5% | Volume resistivity Ω · cm | Hydrolytic stability (total acid number after test) mgKOH/g | Antiwear property (average roughness) μm |
|---|---|---|---|---|---|
| Ex. 7 | −22 | 8 | $2.3 \times 10^{15}$ | 0.01 | 0.13 |
| Ex. 8 | −10 | −12 | $2.3 \times 10^{15}$ | 0.01 | 0.19 |
| Ex. 9 | −31 | −10 | $1.5 \times 10^{15}$ | 0.01 | 0.15 |
| Ex. 10 | −15 | 8 | $4.9 \times 10^{15}$ | 0.01 | 0.14 |

As is apparent from the results of tests on the refrigerator oils of Examples 7 to 10 shown in Table 4. It has been found that the refrigerating machine oils of Examples 7 to 10 were as excellent in compatibility with the HFC refrigerant, electric insulation, hydrolytic stability and antiwear property as those of Examples 1 to 6.

As explained above, the refrigerating machine oil of this invention which contains at least one hydrocarbon compound having the specific structure is excellent in compatibility with the HFC refrigerant, electric insulating, hydrolytic stability and antiwear property, so that all the above requirements for a refrigerating machine oil are satisfied.

Therefore, the refrigerating machine oil of this invention is very useful when it is used together with a hydrofluorocarbon refrigerant (HFC refrigerant). Accordingly, by using the refrigerating machine oil of this invention as a mixture with the HFC refrigerant, there can be obtained a fluid composition of this invention which is capable of maintaining excellent compatibility with each other for a long period of time and is excellent in hydrolytic stability, electric insulation and lubricity, all such requirements are satisfied.

In cases where the refrigerating machine oil of this invention is used in a refrigerator, it is possible to avoid electric leakage even if the oil is used in a sealed compressor having a structure where the oil is in contact with an electrode and it is also possible to fully prevent corrosion otherwise caused by an acid generated by the hydrolysis of the lubricating oil. Furthermore, the refrigerating machine oil of this invention can be used without any need of specific measures taken on a refrigerating machine in which the oil is to be used, effectively preventing the interior of the refrigerating machine from wear.

Therefore, when the refrigerating machine oil of this invention is used as a lubricating oil in the refrigerating machine (cooling system) which operates with a hydrofluorocarbon refrigerant, it will be possible to realize a method for lubricating the cooling system according to this invention so that the cooling system operates stably for a long period of time substantially without causing wear, electric leakage and corrosion with an acid.

Further, when the fluid composition of this invention is used as a circulating fluid in a refrigerating machine which operates with a hydrofluorocarbon refrigerant, it is possible to realize a refrigerating machine of this invention which is capable of stably operating over a long period of time substantially without causing wear, electric leakage and corrosion with an acid, as well as without needing specific measures for preventing the refrigerant and the lubricating oil from separating from each other.

What is claimed is:

1. A fluid composition for use in a refrigerating machine which comprises a refrigerant which consists essentially of a hydrofluorocarbon refrigerant and 1 to 500 parts by weight of a refrigerating machine oil per 100 parts by weight of the hydrofluorocarbon refrigerant, said refriderating machine oil comprising at least one hydrocarbon compound of the following formula (1)

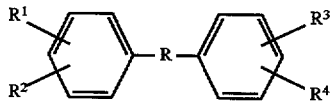

(1)

wherein R is an alkylene or alkenylene group having 1 to 8 carbon atoms; and $R^1$, $R^2$, $R^3$ and $R^4$ are the same or different from each other and are each a hydrogen atom or an alkyl group having 1 to 4 carbon atoms with the proviso that the total number of carbon atoms of R, $R^1$, $R^2$, $R^3$ and $R^4$ is within a range of 1 to 8.

2. The refrigerating machine oil according to claim 1, wherein R is an alkylene group or alkenylene group having 1 to 6 carbon atoms.

3. The refrigerating machine oil according to claim 1, wherein R is an alkylene group or alkenylene group having 1 to 3 carbon atoms.

4. The refrigerating machine oil according to claim 1, wherein R is an alkylene or alkenylene group having 1 to 3 carbon atoms, the total number of carbon atoms of R, $R^1$, $R^2$, $R^3$, and $R^4$ is within a range of 1 to 6 and each of $R^1$, $R^2$, $R^3$ and $R^4$ is a member from the group consisting of a hydrogen atom, methyl, ethyl, isopropyl and sec-butyl groups, with the proviso that at least two of the $R^1$, $R^2$, $R^3$ and $R^4$ are hydrogen atoms.

5. The refrigerating machine oil according to claim 1, wherein R is an alkylene or alkenylene group having 4 to 6 carbon atoms, and $R^1$, $R^2$, $R^3$ and $R^4$ are each a hydrogen atom.

6. The refrigerating machine oil according to claim 1, wherein said at least one hydrocarbon compound is a member selected from the group consisting of phenyltolylmethane, (sec-butylphenyl)phenylmethane, 1-(sec-butylphenyl)-2-phenylethane, 1,1-diphenylethane, 1-phenyl-1-xylylethane, 1-(sec-butylphenyl)-1-phenylethane, 4-methyl-2,4-diphenyl-1-pentene and 4-methyl-2,4,diphenyl-2-pentene.

7. A refrigerating machine which uses therein a fluid composition as a circulating fluid, said fluid composition comprising a refrigerant which consists essentially of a hydrofluorocarbon refrigerant and 1 to 500 parts by weight of a refrigerating machine oil per 100 parts by weight of the hydrofluorocarbon refriderant, said refrigerating machine oil comprising at least one member selected from the group consisting of hydrocarbon compounds of the following formula (1)

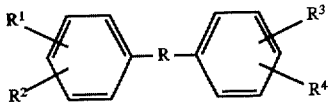

(1)

wherein R is an alkylene or alkenylene group having 1 to 8 carbon atoms; and $R^1$, $R^2$, $R^3$ and $R^4$ are the same or different from each other and are each a hydrogen atom or an alkyl group having 1 to 4 carbon atoms with the proviso that the total number of carbon atoms of R, $R^1$, $R^2$, $R^3$ and $R^4$ is within a range of 1 to 8.

8. A method of lubricating the cooling system of a refrigerating machine in which the refrigerant consists essentially of a hydrofluorocarbon refrigerant, which consists essentially of introducing into said machine as a lubricating oil, a refrigerating machine oil in the amount of 1 to 500 parts by weight per 100 parts of said hydrofluorocarbon refrigerant, said refrigerating oil comprising at least one hydrocarbon compound of the following formula (1)

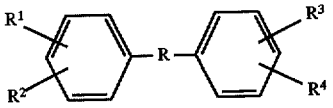

(1)

per 100 parts by weight of said hydrocarbon refrigerant wherein R is an alkylene or alkenylene group having 1 to 8 carbon atoms; and $R^1$, $R^2$, $R^3$ and $R^4$ are the same or different from each other and are each a hydrogen atom or an alkyl group having 1 to 4 carbon atoms with the proviso that the total number of carbon atoms of R, $R^1$, $R^2$, $R^3$ and is $R^4$ within a range of 1 to 8.

* * * * *